United States Patent [19]

Rex

[11] Patent Number: 4,494,724

[45] Date of Patent: Jan. 22, 1985

[54] APPARATUS FOR THE PRODUCTION OF A MONOLITHIC MANHOLE BASE

[76] Inventor: Richard U. Rex, 22586 N. Nottingham Dr., Birmingham, Mich. 48010

[21] Appl. No.: 422,448

[22] Filed: Sep. 20, 1982

[51] Int. Cl.[3] ..... B28B 7/10

[52] U.S. Cl. ..... 249/148; 249/66 A; 425/456

[58] Field of Search ..... 249/144, 147, 66 A, 249/66 C, DIG. 3, 10, 148, 149; 425/456

[56] References Cited

U.S. PATENT DOCUMENTS

| | | | |
|---|---|---|---|
| 934,477 | 9/1909 | Thinnes | 249/149 |
| 2,850,785 | 9/1958 | Rushing | 249/66 A |
| 3,542,327 | 11/1970 | Herzog | 249/144 |
| 3,860,214 | 1/1975 | Schmidgall | 249/144 |
| 3,939,234 | 2/1976 | Dashew | 249/66 A |
| 4,261,541 | 4/1981 | Morrow | 249/10 |

*Primary Examiner*—Donald Czaja
*Assistant Examiner*—V. Fischbach
*Attorney, Agent, or Firm*—Bruns and Wall

[57] ABSTRACT

A manufacturing technique for producing a monolithic concrete base for a manhole, wet well, junction chamber in an upright position that includes a jacket having a removable pallet that forms the bottom wall thereof. A core is suspended inside the jacket upon two sets of horizontally aligned spacer pins. The first set of pins is situated below the level to which the concrete is to be poured while the second set is situated above the pouring level. After the molding unit has been filled to the required level, the upper set of pins is removed and a contoured forming header placed over the top surface of the concrete before it has a chance to set in order to create a joint for receiving another section thereon.

6 Claims, 3 Drawing Figures

APPARATUS FOR THE PRODUCTION OF A MONOLITHIC MANHOLE BASE

BACKGROUND OF THE INVENTION

This invention relates generally to a monolithic concrete manhole base and, in particular, to an improved technique for manufacturing a manhole base in an upright position.

A poured concrete manhole base usually consists of a horizontally aligned pedestal that is adapted to support a vertical riser thereon. Generally, the riser is a hollow cylindrical member that may be used as a wet well or junction chamber for containing fluids. It is therefore important that the manhole possesses high strength and be leakproof to insure that the fluids will not escape or ground water enter, and thus degrade the system. By forming both the pedestal and the riser from a single piece of concrete, relatively high strength can be achieved and to a large extent the watertight integrity of the structure preserved. However, casting a one piece section of this type has proven to be rather difficult.

In order to overcome some of the problems associated with manufacture of a truly monolithic base, the base is sometimes cast in an inverted position. The mold contains a pallet upon which is seated a cylindrical closed top inner core and a cylindrical outer jacket in coaxial alignment to provide a space therebetween. The sidewall of the jacket is higher than that of the core so that concrete can be poured over the top of the core to create the pedestal. Upon curing sufficiently, until the concrete is hard and strong enough to be handled, the entire assembly is turned right side up and placed down on its base. The pallet, core and jacket are stripped from the concrete section and the concrete product is removed to storage. As can be seen, the component parts of the mold must remain assembled for a relatively long period of time to permit the concrete to cure, before the casting can be turned over without disturbing the concrete structure. It is therefore necessary to employ a large number of mold parts if any volume of production is to be maintained. This added equipment increases the cost of production and correspondingly raises the cost of the product.

By manufacturing the manhole base section in a normal upright position and using a semi-dry concrete mix, the core and the jacket may be quickly stripped from the product and reused in the manufacturing process. In U.S. Pat. No. 3,860,214, a method of manufacturing base sections in an upright position is disclosed. In this particular arrangement, the core is supported on the pallet in a raised position upon three legs. In assembly, the legs are locked to the pallet by a rather complex locking mechanism and the jacket then placed around the core. After placing the concrete, the core and the jacket are quickly stripped away without disturbing the product and thus can be rapidly turned around to once again form another base.

It must be noted, however, that the legs appended to the core produce three relatively large holes in the pedestal of the base section when the core is removed. These holes must be filled or somehow patched with concrete to complete the structure. The patched section thus represents a weak section in the base that can cause cracking which will eventually weaken the structure and/or permit contained fluids to leak therefrom thus disturbing the fluid handling capability of the system. It should be further noted that unlocking the legs from the pallet is difficult and can sometimes result in a time-consuming and relatively frustrating task. The pallets, because of the locking feature associated therewith, must be specially prepared and thus represent a relatively costly item which increases the cost of the product, particularly where large numbers are required.

SUMMARY OF THE INVENTION

It is therefore an object of the present invention to improve the apparatus for manufacturing monolithic concrete manhole wet well or junction chamber bases.

A further object of the present invention is to improve apparatus for constructing a concrete manhole base in an upright position.

Another object of the present invention is to simplify the construction of a monolithic concrete manhole base.

Yet another object of the present invention is to eliminate the need for forming holes in the pedestal of a concrete manhole base during the manufacture thereof.

A still further object of the present invention is to provide a truly monolithic, high strength concrete manhole base that can be used either as a wet well or as a junction chamber.

Still another object of the present invention is to provide apparatus for constructing a concrete manhole base in an upright position that requires the use of a relatively simple pallet for supporting the base while it is curing.

These and other objects of the present invention âre attained by means of apparatus for manufacturing a concrete manhole base that includes an outer jacket having a vertical sidewall and a pallet that is slidably received in the bottom of the jacket to form a horizontal bottom wall therein. A core is suspended within the jacket upon two sets of horizontally aligned spacer pins which both support and align the core in assembly. One set of pins is spaced 90° vertically above the other and then the concrete is brought to a level somewhere between the two sets of pins. The upper set of pins is then removed and a contoured header placed against the top surface of the still workable concrete to establish a joint therein.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 3:
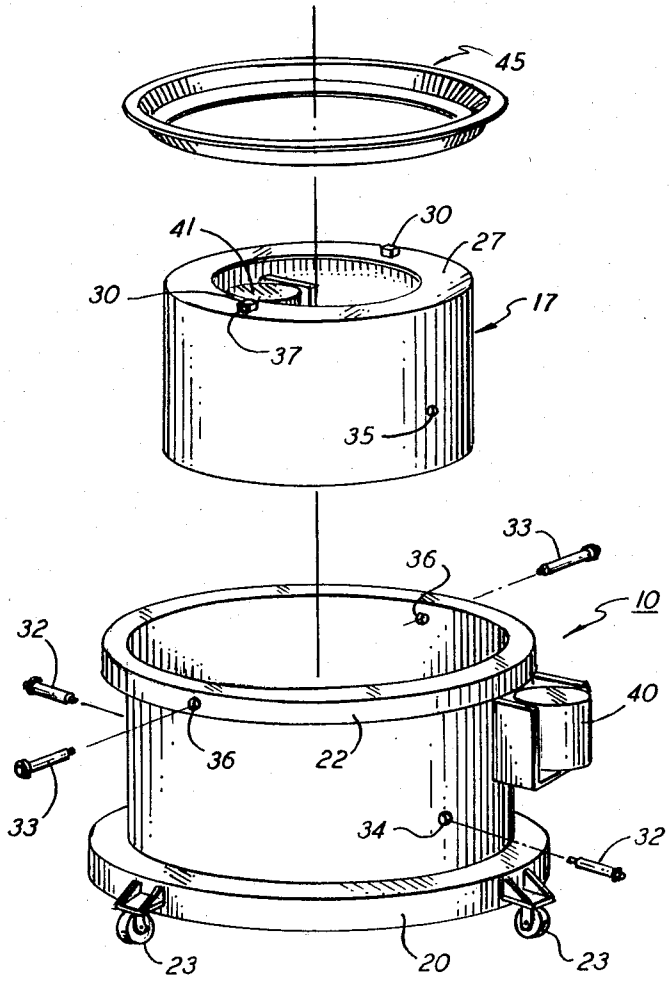
FIG. 3 is an exploded view of the apparatus shown in FIGS. 1 and 2 further illustrating the construction thereof.

With further reference to the drawings, there is shown casting apparatus, generally referenced 10, that is used to manufacture a monolithic manhole base 12 in an upright posture, that is, in a posture wherein the pedestal 14 of the base is situated in a horizontal plane and the sidewall or riser 13 extends upwardly therefrom in a vertical direction. The present apparatus further includes a flat pallet 15 that is received in the bottom of a cylindrical steel jacket 16 to provide an open topped assemblage that is capable of retaining a concrete mix therein. As will be explained in greater detail below, a cylindrical core is suspended within the jacket by means of spacer pins. When the core is suspended upon the pins, a space is provided between the core and the jacket as well as the core and the pallet which describes the geometry of the manhole base. Although in this embodiment of the invention the core and the jacket are both cylindrical in form, it should be clear that the shape and size of these forms may be varied to create sections having different configurations without departing from the teachings of the present invention.

The jacket, as illustrated, has a radially extended annular flange 20 that encircles its lower margin. The flange serves to radially extend the pedestal 14 of the poured structure beyond the outer periphery of the riser section 13 and also adds some support to the structure. An annular reinforcing collar 22 also encircles the top margin of the jacket to provide added rigidity to this section of the jacket sidewall. Although not shown, a support bracket or the like is placed under the pallet to help support both the pallet and the poured concrete base in assembly.

The core 17 is a hollow member that has a sidewall 25 which is integral with a bottom wall 26 and an upper wall 27. A pair of diametrically-opposed mounting blocks 30—30 are welded or otherwise affixed to the upper wall 27.

Figure 1:
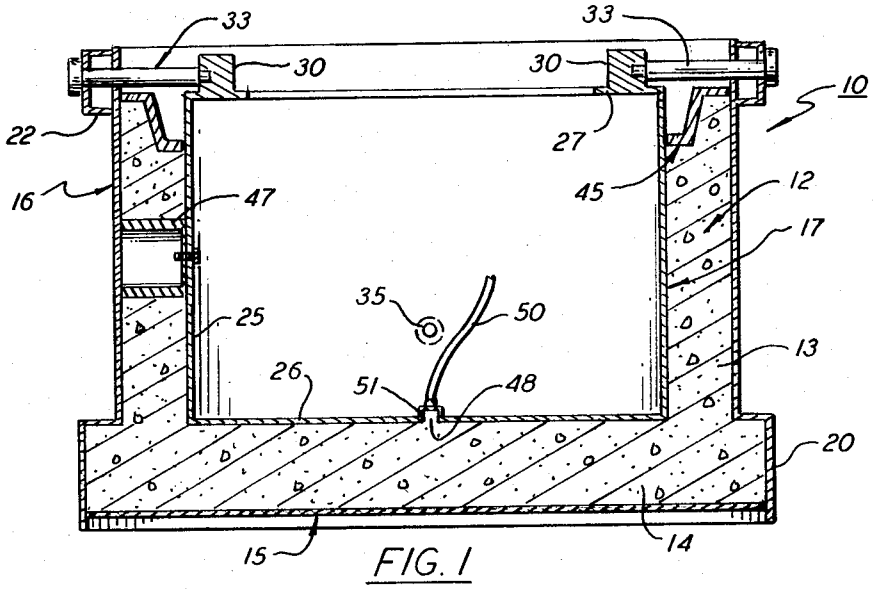
FIG. 1 is a side elevation in section that is taken through the common horizontal centerline shared by the upper set of spacer pins which illustrate apparatus embodying the present invention for manufacturing a truly monolithic concrete manhole base.
Figure 2:
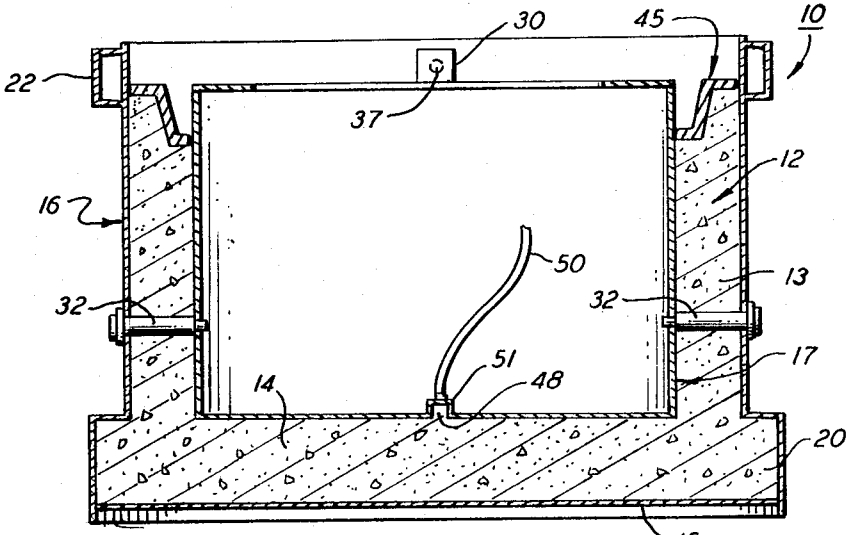
FIG. 2 is a second side elevation in section that is taken through the common horizontal centerline shared by the lower set of spacer pins.

As noted, the core is both supported and aligned within the jacket by means of two sets of spacer pins that include a shorter, lower set of pins 32—32 and a longer, upper set of pins 33—33. Each set of pins contains a pair of opposed elements that are horizontally aligned along a common centerline or axis. Each pin contains an expanded head, a cylindrical body of predetermined length, and a reduced tip that protrudes outwardly from the body. In assembly, the lower set of pins is passed through opposed holes 34—34 formed in the sidewall of the jacket and the tips thereof are slidably received within similarly aligned receiving holes 35—35 formed in the core. When the heads of the pins are seated in contact against the outer wall of the jacket and locked in position, as shown in FIGS. 1 and 2, the body of the pins acts against the core to automatically center it along the vertical axis of the jacket. Although not shown, any suitable pin locking device as known and used in the art may be used to hold the pins in assembly. The upper set of pins is similarly passed through opposed holes 36—36 formed in the collar 22 and is seated in receiving holes 37—37 formed in the noted mounting blocks. The body length of the upper pins is greater than that of the lower pins to compensate for the wider collar section. However, once seated in the blocks and locked in position, the upper pins again function to both support and centrally locate the core in assembly.

Once the spacer pins have been properly seated in assembly, the weight of the core is allowed to rest entirely thereon which, in turn, locks the core to the frame. Preferably, the common axes of pins are orthogonally positioned so as to space the pins equally at 90° intervals about the jacket. Although two pairs of equally-spaced pins are shown in the main embodiment of the invention, it should be apparent to one skilled in the art that the number and positioning of the pins can be altered without departing from the teachings of the invention. As best illustrated in FIGS. 1 and 2, with the core suspended within the jacket and the pallet in place, a space is created between the assembled components which defines the geometry of the concrete structure to be cast.

Concrete is now placed in the space through the upper circular opening so as to fill the pedestal region 14 and to bring the riser section 13 to a predetermined level which is somewhere between the two sets of pins. Accordingly, after casting, the lower set of pins is encompassed by concrete while the upper set remains above the top surface of the mix. Preferably, a dry cast method is employed in which a dry stiff concrete is used in the mix and compacted by mechanical vibration to furnish a relatively strong self-standing base in a very short period of time after the concrete is cast. Relatively high vibrating forces are used during pouring to help the mix flow into and completely fill the pedestal region thus providing a highly compact structure that is free of voids. To this end vibratory units 40 and 41 (FIG. 3) are mounted upon both the jacket and the core, respectively, that operate to deliver sufficient vibratory forces into the mix to accomplish this end.

After the mix has been placed to the predetermined level, the upper set of pins is removed from the assembly and a joint forming header 45 is passed through the top opening in the assembly and seated upon the top surface of the riser. The header is pressed down into the uncured mix to generate a joint suitable for receiving another mating section therein. As can be seen, the poured concrete helps to both support and align the mold parts together in assembly so that the upper pin can be pulled in complete safety.

One or more hole-forming inserts 47 may be inserted between the jacket and core as shown in FIGS. 1 and 2 to form pipe-receiving openings in the product, if required.

To strip the forms after the manhole base has been cast, the lower spacer pins, and any hole-forming insert fastenings that are present, are initially removed from the assembly to free the core. An air inlet port 48 is formed in the bottom wall 26 of the core and a two inch pneumatic air supply line 50 is coupled to the port by means of a connector 51. Although not shown, a manually operated slide gate is operatively connected to the inlet port which serves to close the port when concrete is being poured or placed in the mold. After pouring is completed, the gate is opened and air is introduced through the port between the pedestal of the casting and the core under sufficient pressure to raise the core to an elevation where it can be easily removed from the assembly. After the core has been removed, the jacket is stripped by raising it upwardly over the top of the casting. This leaves the concrete base seated upon the flat pallet in an upright position thereby eliminating many troublesome handling problems heretofore associated with this type of product.

In practice, the holes left behind after removal of pins 32—32, are located at or above the center of gravity of the manhole base structure. Accordingly, after the casing has sufficiently cured, lifting pins are passed into the hole and the entire structure lifted in an upright position from the pallet and conveniently transported to storage. Although not shown, a manually operated air vent may be placed in the bottom wall of the core 17 which when opened allows air in the base region 14 of the cavity to escape during pouring and which when closed, allows the core to be raised by introducing air into the cavity via air hose 50.

While this invention has been described with reference to the details as set forth above, it is not limited to the specific structure as disclosed and the invention is intended to cover any modifications or changes as may come within the scope of the following claims.

I claim:

1. A releasable molding apparatus for manufacturing manhosidewall a pallet removably received with the jacket which forms a horizontally disposed bottom wall, a one piece cylindrical core that is receivable within the open top of the jacket, said core having a vertically disposed side wall that is of a smaller diameter than that of the said jacket and a horizontally disposed bottom wall whereby the core is capable of coating with the jacket and the pallet to provide a pouring cavity therebetween into which concrete is poured to a predetermined level to produce a manhole base section having a floor and a raised sidewall, hanger means for suspending the core within the jacket that includes a first pair of spacer pins that are axially aligned along a first common diametrical line of the jacket lying between the predetermined level and the center of gravity of the base section whereby the holes created by the spacer pins in the concrete section can be used to lift the base section from the pallet, and a second set of spacer pins also passing between the jacket and the core which are axially aligned along a second common diametrical line of the jacket that lies above the said predetermined level whereby the second pair of spacer pins can be removed after the concrete base section has been cast, said first and second common diametrical lines being at about right angles in relation to each other to support the core in axial alignment with the vertical axis of the jacket.

2. The apparatus of claim 1 that further includes a joint forming header that is passed between the core and jacket after the second pair of spacers have been removed to form a pipe receiving joint in the top of the base section.

3. The apparatus of claim 1 that further includes at least one insert mounted between the jacket and the core to establish a pipe opening within the cast base section.

4. The apparatus of claim 1 wherein each spacer pin contains a pair of spaced apart stop surfaces that are arranged to seat against the jacket and the core respectively, to align the core within the jacket along the vertical axis of said jacket.

5. The apparatus of claim 1 that further includes a port formed in the horizontally disposed bottom wall of the core and pneumatic means operatively connected to the port for introducing air between the core and the floor of the base section to facilitate removal of said core from the base section.

6. The apparatus of claim 1 that further includes vibratory means secured to the jacket or core for agitating the concrete as it is being cast.

* * * * *

UNITED STATES PATENT AND TRADEMARK OFFICE

CERTIFICATE OF CORRECTION

PATENT NO. : 4,494,724

DATED : Jan. 22, 1985

INVENTOR(S) : RICHARD U. REX

It is certified that error appears in the above—identified patent and that said Letters Patent is hereby corrected as shown below:

In Claim 1, Column 5, line 13, change "manhosidewall" to -- manhole base sections that includes a cylindrical outer jacket having a vertically disposed sidewall --

Column, 5, line 22, "coating" should be -- coacting --.

Signed and Sealed this

*Fourteenth* Day of *May 1985*

[SEAL]

*Attest:*

DONALD J. QUIGG

*Attesting Officer* *Acting Commissioner of Patents and Trademarks*